United States Patent [19]

McAllister, Jr.

[11] 4,140,402

[45] Feb. 20, 1979

[54] MIXING MEANS FOR ASPHALT MATERIAL

[76] Inventor: LeRoy H. McAllister, Jr., R.R. #1, Zionsville, Ind. 46077

[21] Appl. No.: 833,469

[22] Filed: Sep. 15, 1977

Related U.S. Application Data

[63] Continuation-in-part of Ser. No. 703,646, Jul. 8, 1976, abandoned.

[51] Int. Cl.[2] ..... B01F 7/00; B01F 15/06

[52] U.S. Cl. ..... 366/279; 366/144; 366/302

[58] Field of Search ..... 366/144, 145, 146, 279, 366/282, 283, 284, 244, 245, 302, 306

[56] References Cited

U.S. PATENT DOCUMENTS

| | | | |
|---|---|---|---|
| 718,319 | 1/1903 | Cunningham | 366/306 |
| 2,571,366 | 10/1951 | Jennings | 366/282 |
| 3,256,561 | 6/1966 | Rodenacker | 366/144 X |
| 3,426,442 | 2/1969 | Satake | 366/144 |

FOREIGN PATENT DOCUMENTS

| | | | |
|---|---|---|---|
| 71730 | 6/1928 | Sweden | 366/302 |

*Primary Examiner*—Edward J. McCarthy
*Attorney, Agent, or Firm*—Robert A. Spray

[57] ABSTRACT

A mixer means for asphalt materials, particularly Trinidad Lake Asphalt. It has a revolving rotor assembly which carries longitudinally-extending mixer blades, the blades being perforate and thereby providing more thoroughness of the mixing procedure by which the asphalt particulate chips are caused to go into a sort of suspension in the liquid solvent of other asphalts or oils, even though the mixer blades are substantially larger than the particles being mixed. There are heater coil means extending inwardly from the tank ends, the support of the mixer blades being such as to accommodate the heater means without interference from revolving members of the rotor assembly.

6 Claims, 3 Drawing Figures

MIXING MEANS FOR ASPHALT MATERIAL

This application is a Continuation-In-Part of pending U.S. patent application, Ser. No. 703,646, filed July 8, 1976, now abandoned, by the same inventor LeRoy H. McAllister, Jr.

The present invention relates a mixing means for the processing of asphalt material known as Trinidad Lake Asphalt and other crushable asphalts.

More particularly, the present inventive concepts relate to a mechanism, particularly useful for such asphalt materials, which achieves a desired intimate mixing of the components thereof.

The substances which eventually go together to produce Trinidad Lake Asphalt are considered to be relatively difficult to melt and mix; yet the quality of the finished asphalt is considered to be dependent to a large extent upon the character and quality of the processing by which they do achieve a high thoroughness of mix.

Trinidad Lake Asphalt contains about 35% (by weight) of mineral matter which is finely divided; and this provides a very desirable filler in the making of various types of asphaltic end-products, such as asphaltic concrete, sheet asphalt, rolled asphalt, and mastic asphalt.

However, this unique nature of Trinidad Lake Asphalt, that is, its high content of finely divided material, poses particular manufacturing problems. More particularly, the mixing procedures must be such as to provide very much surface contact of the solvent with the particulate matter; and it must prevent the settling out of the mineral matter, that is the Lake Asphalt chips as they are commonly called.

Prior to the present invention, thorough mixing has been particularly difficult in view of difficulties of other mixing means or methods. For example, a mixing procedure involving air agitation from the bottom of a tank or hopper may impair the quality of the product. Agitation by procedures involving steam have a special disadvantage of inherently requiring the availability of steam. Other systems of mechanical agitation do not appear to be effective.

Accordingly, concepts of the present invention avoid disadvantages of prior methods, and provide a novel and advantageous means or mechanism for processing the materials of Trinidad Lake Asphalt, more particularly the intimate mixing of the particulate mineral matter with other asphalts or oils.

Further, by the present invention the Lake Asphalt chunk particles are crushed or broken into small chips; and these chips are then caused by the mixing means to contact or be contacted, intimately and repeatedly, with the solvent material (liquid asphalt and/or oil) until they are suspended in the solvent in a fairly homogenously dispersed condition, referred to being "in solution" (although it is not believed that they are actually in solution in the sense of being dissolved in the sense of ionic or molecular dispersion that salt or sugar is dissolved in water, for example), or perhaps it is more apt to describe the resulting substance or mixture as a "suspension".

The mixer means of the present invention not only provides the aforesaid thorough and intimate mixing or agitation, but it provides against the settling out of the Lake Asphalt's mineral filler particles.

In carrying out the invention, the mixing means provide that the crushed chip particles are delivered into a tank and are permitted to descend through the solvent. The chip particles which are not mixed with the solvent sufficiently so as to be suspended therein fall to the region adjacent the tank bottom, where the mass is stirred and moved upwardly by perforate rotating blades of the mixer mechanism. The rotation of the mixer blades is continuous, and causes substantially all of the particulate mineral matter to be sooner or later suspended to provide the high degree of homogeneity desired.

The above explanation is of somewhat introductory and generalized nature. More particular objects, features, concepts, and advantages of the present invention will be more fully apparent in the following more detailed description of an illustrative embodiment, reference being had to the accompanying somewhat schematic or diagrammatic drawings, in which.

Figure 1:
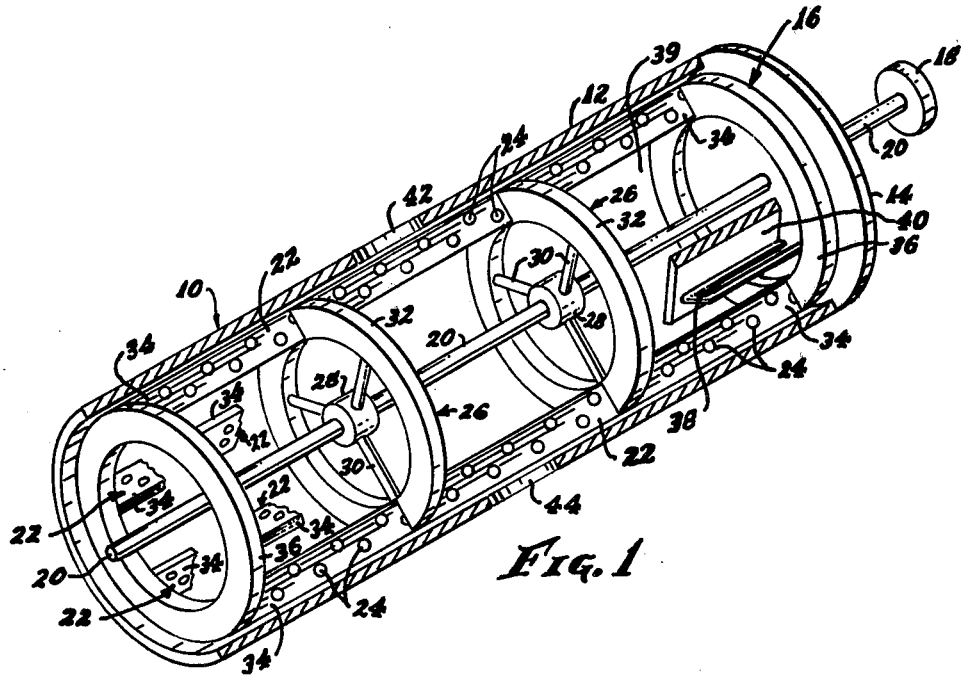
FIG. 1 is a pictorial view of a mixing means for processing asphalt material; and to avoid obscuring details otherwise hidden, there are shown as broken away portions of the tank or shell, portions of some of the mixer blades or plates, and portions of the baffle arrangement. Certain well-known components such as packing and bearings are generally omitted.
Figure 2:
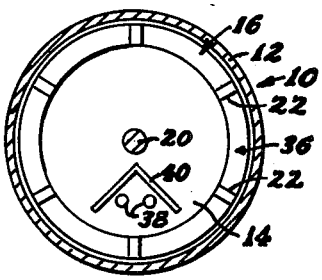
FIG. 2 is a lateral cross-sectional view of the end portion of the mixing means, taken generally as indicated by View-line 2—2 of FIG. 1. And, FIG. 3 is a fragmental detail illustrating a portion of one of the perforated blade members thereof.
Figure 3:
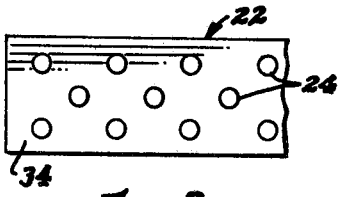

As shown in the drawings, the present invention provides a mixing means for the intimate mixing of asphalt materials, particularly those of so-called Trinidad Lake Asphalt, after they have been crushed to a small size.

Primary components are a mixing tank 10, shown as a cylindrical shell-like body having a cylindrical shell 12 and end members 14, and a rotor assembly 16 indicated as having an associated rotational drive means 18 which causes the rotor assembly 16 to rotate on its axis shown as a shaft 20.

The rotor assembly 16 includes a peripheral series of mixer blades 22 which extend longitudinally of the axis 20 of the tank 10 and of the rotor assembly 16.

The mixer blades 22 are carried outwardly of the shaft axis 20 of the rotor assembly 16 in closely adjacent proximity to the shell 12 of the tank 10 so as to be able to operatively contact substances or materials contained in the tank 10, though carried on or closely adjacent the tank's longitudinal shell 12.

It will be noted that the mixer blades 22 are provided with perforations 24 thereby providing thoroughness of mixing of even small particles of materials even though the blades 22 are themselves significantly larger.

The rotor shaft 20 supports the blades 22 of the rotor assembly 16 by support arm means shown as wheel-like members 26 having an inner hub 28 fastened to rotor shaft 20 and having extending therefrom radial support arms 30 which supportingly carry at their outer ends a support ring 32 which supports the mixer blades 22. The two support arm means 26, it will be noted, are located substantially inwardly of the ends 14 of the tank 10, leaving the tank's end-regions free of rotating members for a substantial distance both axially and radially of the rotor shaft 20 even though the outer ends 34 of blades 22 are supportingly interconnected by support rings 36.

Keeping the substances heated, for better mixing thereof, there are shown heater means 38 which are provided in the interior of the tank 10 in the zone 39 between the tank ends 14 and the outer of the support arm means 26.

There are also provided baffle means 40, over the heater means 38, thereby preventing the fouling of the heater means 38 by falling material, yet allowing convective flow upward through the region 39 of the heater means 38.

In operation, the particulate asphalt material "chips" as well as the solvent (other asphalts and/or oils) are introduced into the mixer tank 10 through an upper inlet opening 42, and are eventually discharged via the discharge opening 44 along the bottom of the tank 10.

The drive means 18 causes the rotor assembly 16 to revolve, the mixer blades 22 keeping the materials in a stirring agitation, and the blade-perforations 24 accommodating the intermixing movement of particles and solvent. The baffles 40 prevent the falling particulate matter or chips from fouling the heater coils 38, as the particles fall prior to being dispersed fully in the suspension medium; and the revolving blades 22 continue the mixing action until the suspension is sufficiently homogenous.

SUMMARY

It is thus seen that a mixer means for asphalt material, according to concepts of the present invention, provides novel and advantageous concepts and features, providing not only an effective mixer means but one which avoids or overcomes disadvantages of other mixer mechanisms.

Particularly advantageous for Trinidad Lake Asphalt materials, it achieves desirable advantages of thorough mixing, without settling out, by providing much and continuous surface contact of the materials or substances being mixed, and avoids quality-harming air agitation means, and avoids the need for steam needed in other mixing mechanisms.

Accordingly, it will thus be seen from the foregoing description of the invention according to this illustrative embodiment, considered with the accompanying drawings, that the present invention provides a new and useful mixing means for asphalt materials, which achieves the desirable goal of achieving a good and satisfactory mixing which results in a high quality end product, the mixer means having desired advantages and characteristics, and accomplishing its intended objects, including those hereinbefore pointed out and others which are inherent in the invention.

Modifications and variations may be effected without departing from the scope of the novel concepts of the invention; accordingly, the invention is not limited to the specific form or arrangement of parts herein described or shown for illustration of the inventive concepts.

What is claimed is:

1. A mixing means for the intimate mixing of asphalt materials, comprising:

a mixing tank having a generally smooth and cylindrical interior wall which defines a dissolving and mixing chamber, the enclosure wall of which is generally smooth;

a rotor assembly, and rotation means therefor;

the rotor assembly including a peripheral series of mixer blades extending parallel with respect to one another and longitudinally of the axis of the tank and of the rotor assembly, and supported in an assembly which provides that the outer edges of the series of blades are in a cylindrical configuration;

the said blades being carried outwardly of the axis of the rotor assembly in closely adjacent proximity to the tank so as to operatively contact substances or materials contained in the tank even though carried on or being closely adjacent to the tank's longitudinal shell.

2. The invention as set forth in claim 1 in a combination in which the tank is supported in a horizontal position and the axis of the tank and rotor assembly are horizontal, and in which the mixer blades are provided with perforations thereby providing thoroughness of mixing of even small particles of materials even though the blades are significantly larger than any particles of the materials or substances being mixed; and the combination of those blade-perforations and the horizontal mounting of the tank and rotor assembly provides that the generally radially-extending surfaces of the mixer blades as they move in their arcuate path from their lowest point to their highest point provide a more effective contacting of solid particles riding on those blade surfaces, by the liquid, thereby achieving faster and more thorough dissolution of the solid material into the liquid.

3. The invention as set forth in claim 1 in a combination in which radially-extending shaft means support the blades of the rotor assembly by support arm means;

the support arm means being located substantially inwardly of the ends of the tank;

heater means being provided in the interior of the tank in the zone between the tank end and the said support arm means, but wholly longitudinally outwardly of the end-most support arm means, thereby being wholly contained in a non-interfering relation to the radially-extending support arm means;

and the rotor is supported by a support shaft itself supported axially within the cylindrical tank and concentric therewith but the said heater means is mounted offset from the coincident axis of the said tank and rotor assembly's support shaft.

4. The invention as set forth in claim 2 in a combination in which radially-extending shaft means support the blades of the rotor assembly by support arm means;

the support arm means being located substantially inwardly of the ends of the tank;

heater means being provided in the interior of the tank in the zone between the tank end and the said support arm means, but wholly longitudinally outwardly of the end-most support arm means, thereby being wholly contained in a non-interfering relation to the radially-extending support arm means;

and the rotor is supported by a support shaft itself supported axially within the cylindrical tank and concentric therewith but the said heater means is mounted offset from the coincident axis of the said tank and rotor assembly's support shaft.

5. The invention as set forth in claim 3 in a combination in which there are provided baffle means over the heater means thereby preventing the fouling of the heater means by falling material yet allowing convective flow upward through the region of the heater means.

6. The invention as set forth in claim 4 in a combination in which there are provided baffle means over the heater means thereby preventing the fouling of the heater means by falling material yet allowing convective flow upward through the region of the heater means.

* * * * *